United States Patent [19]

Zumfeld

[11] Patent Number: 4,938,013

[45] Date of Patent: Jul. 3, 1990

[54] SPLICING HEAD WITH VARIABLE COMPRESSED AIR ENTRANCE OPENINGS

[75] Inventor: Heinz Zumfeld, Monchen-gladbach, Fed. Rep. of Germany

[73] Assignee: W. Schlafhorst & Co., Fed. Rep. of Germany

[21] Appl. No.: 286,357

[22] Filed: Dec. 19, 1988

[30] Foreign Application Priority Data

Dec. 22, 1987 [DE] Fed. Rep. of Germany ..... 3743516

[51] Int. Cl.[5] ..... D01H 15/00

[52] U.S. Cl. ..... 57/22; 57/350

[58] Field of Search ..... 57/22, 23, 202, 350

[56] References Cited

U.S. PATENT DOCUMENTS

| | | | |
|---|---|---|---|
| 4,232,509 | 11/1980 | Rohner et al. | 57/22 X |
| 4,397,140 | 8/1983 | Sheehan et al. | 57/22 |
| 4,441,308 | 4/1984 | Rohner et al. | 57/22 |
| 4,445,317 | 5/1984 | Mima | 57/22 |
| 4,494,366 | 1/1985 | Deno | 57/22 |
| 4,653,258 | 3/1987 | Rohner | 57/22 |
| 4,693,066 | 9/1987 | Oellers | 57/22 |

FOREIGN PATENT DOCUMENTS 3040588 3/1982 Fed. Rep. of Germany .

3153083 3/1985 Fed. Rep. of Germany .

*Primary Examiner*—Joseph J. Hail, III

*Attorney, Agent, or Firm*—Shefte, Pinckney & Sawyer

[57] ABSTRACT

A splicing head for a compressed air yarn splicing device has a splicing chamber with a yarn insertion slot opening thereinto and an arrangement by which a pair of compressed air entrance openings may be adjustabley located at differing dispositions with respect to the splicing chamber so that differing splicing air vortices may be selectively generated within the splicing chamber as required for differing yarn characteristics. A common compressed air supply with a single control valve is provided for supplying compressed splicing air to each entrance opening. In one embodiment, a plurality of entrance openings are formed in the splicing head and a shiftable slide plate having a pair of compatible openings enables selective communication between the compressed air supply and the splicing chamber through alternate pairs of the plural entrance openings. In another embodiment, a pair of the entrance openings are formed in a shiftable member mounted to the splicing head for adjustable disposition of the openings relative to the splicing chamber. The splicing head thereby eliminates the need for a plurality of interchangeable specialized splicing heads.

14 Claims, 2 Drawing Sheets

SPLICING HEAD WITH VARIABLE COMPRESSED AIR ENTRANCE OPENINGS

BACKGROUND OF THE INVENTION

The present invention relates generally to yarn splicing devices of the type having a splicing chamber wherein two yarn ends may be spliced by means of vortices of compressed air admitted into the chamber through entrance openings.

Conventionally, the joinder of yarn ends in spinning or bobbin winding machines is performed almost exclusively by splicing procedures, commonly utilizing compressed air. Often, an individual splicing device may be provided at each spinning or winding position in such machines. Accordingly, a considerable increase in the performance of the individual spinning and winding positions is made possible since each correction of a yarn break and each connection of a new yarn to a preceding one is performed automatically at the particular spinning or winding position.

The preparation of the yarns as well as the splicing process itself is known to have a considerable influence on the strength of the resultant splice. The objective in each case is to obtain a splice of a strength at least approaching that of the yarn being spliced. The actual strength of any given splice depends upon whether the compressed air is directed into the splicing chamber in a manner producing an optimal vortexing of the fibers of the individual yarn ends, which is a function in each case of varying yarn parameters such as, for example, the yarn count, the constituent fiber material and the twist direction of the yarn. Thus, a splicing chamber must be specifically designed in relation to particular well-defined yarn parameters and splicing requirements.

As a result, it has become conventional practice in the use of known splicing devices to provide a number of interchangeable splicing heads, each of which is adapted for optimal splicing performance with yarns of specific characteristics. Accordingly, when the operating characteristics of a spinning or winding machine are altered, such as a change in the yarn material, yarn count or twist, new splicing heads must typically be substituted in the splicing devices at the individual spinning or winding positions. This requirement of exchanging the splicing heads disadvantageously requires a considerably amount of work and further requires that an expensive inventory of interchangeable splicing heads be maintained.

U.S. Pat. No. 4,397,140 discloses a known device and method for splicing multi-filament yarn or tow of differing diameters ranging from 100 to 2850 denier. To this end, several compressed air entrance openings are provided in the splicing device, each of which is individually connected to a respective compressed air supply line in which a respective regulator valve is provided to control the splicing air as needed during the splicing process. However, this device is only suitable for rather course yarns and tow, as indicated from the dimensions of the splicing chamber and the denier range of yarns and tow disclosed in this patent. Moreover, the provision of an individual connection of each compressed air entrance opening to an individual regulator valve represents a considerable expense, especially with regard to coordinating the opening actuation of the individual valves.

SUMMARY OF THE INVENTION

It is accordingly an object of the present invention to provide a compressed air splicing head of a simple design which is capable of splicing relatively low count staple fiber yarns of differing yarn characteristics so that the conventional practice of interchanging differing specialized splicing heads may be avoided.

The present invention provides a splicing head for use in a compressed air yarn splicing device, which achieves this objective. Briefly summarized, the splicing head of the present invention is stationarily disposed within the splicing device and has a splicing chamber for receiving a pair of yarn ends to be spliced and a slot opening into the chamber for insertion of the yarn ends thereinto. According to this invention, means are provided for selectively defining a pair of compressed air entrance openings for delivering compressed splicing air into the splicing chamber at differing locations therein for selectively generating differing splicing air vortices within the splicing chamber in relation to characteristics of the yarn ends. An air supply arrangement defines a common conduit from a common source of compressed air to each of the compressed air entrance openings for supplying compressed air thereto, the air supply arrangement including a controllable valve in the common conduit.

In this manner, it is possible to provide the splicing head with a minimal necessary number of the compressed air entrance openings and to design the compressed air supply arrangement to be as simple as possible to operate. At the same time, the invention enables the compressed air entrance openings to be selectively located to achieve an optimal adjustment of the splicing capabilities of the splicing head in accordance with differing yarn parameters such as aforementioned, i.e. yarn count, fiber material and yarn twist.

The provision of only a single regulator valve in the compressed air supply arrangement common to each of the compressed air entrance openings enables the control of the valve to be considerably simpler and less susceptible to operational problems than if each compressed air entrance opening were to be connected to a respective compressed air supply having its own respective regulator valve. Thus, the need for coordination of the actuation and deactuation of the individual valves in relation to one another is eliminated. Additionally, the space occupied by the single valve is considerably less than that required by a number of valves and, accordingly, the splicing head of the present invention is thereby enabled to be incorporated into each spinning or winding position.

In one embodiment of the present invention, a plurality of the compressed air entrance openings are provided in association with a movable slide member or other suitable means disposed between the compressed air supply arrangement and the splicing chamber for movement between differing operative dispositions for selectively opening and closing the entrance openings in predetermined pairs. Thus, in different positions of the slide or other movable member, the compressed air supply arrangement is communicated with the splicing chamber through different compressed air entrance openings to achieve differing splicing results. The slide member preferably is provided with a number of openings adapted to align with selected ones of the compressed air entrance openings in the different positions of the slide member. As desired, the slide member may be in the form of a circular plate rotatably mounted to the splicing head or, alternatively, the slide member may be configured and arranged for relative linear movement between its different operative dispositions. In this manner, operative communication between the compressed air supply arrangement and the compressed air entrance openings as selected for producing any desired air vortex pattern within the splicing chamber may be established in a simple manner.

In an alternate embodiment of the present invention, a pair of air entrance openings may be formed in a member movably mounted to the splicing head so that the disposition of the air entrance openings relative to the splicing chamber may be selectively varied to selectively adjust the manner of communication between the compressed air supply arrangement and the splicing chamber. Preferably, the means defining the splicing chamber also defines a recess opening into the splicing chamber which receives and conforms to the movable member for disposition of the member in different positions within the recess. In this manner, the disposition of the compressed air entrance openings may be varied within a relatively wide range with respect to the yarn ends to be spliced within the splicing chamber. Preferably, the movable member is arranged so that its adjusting movement is symmetrical with respect to a plane extending through the longitudinal axis of the splicing chamber. Such may be achieved in a simple manner by rotational disposition of the movable member within its recess.

In this embodiment, it is additionally possible to adjust the spacing of the compressed air entrance openings with respect to the splicing chamber by mounting of the movable member in its recess for selective positioning toward and away from the splicing chamber. The movable member may be clamped within the recess by the provision of any suitable clamping device preferably actuated from the exterior of the splicing head, e.g., by means of a clamping screw or by a self-locking arrangement such as a clamping spring.

Preferably, the movable member and its recess are formed of compatible circular configurations to advantageously facilitate the adjusting movements rotationally with respect to the splicing chamber as well as toward and away therefrom, as aforementioned.

To advantageously facilitate repeatable setting of the movable member in predetermined operative dispositions, mechanical stops or another suitable stop means may be provided in each embodiment for fixing the positioning of the movable member. Likewise, the movable member in each embodiment may be provided with a handle, preferably accessible from the exterior of the splicing head, for actuating positioning movement of the movable member.

In each embodiment, the movable member enables adjustment of the splicing head to accommodate the splicing of either S-twisted or Z-twisted yarns. For example, in the first-described embodiment, four compressed air entrance openings may be provided, each opening into a respective one of four quadrants of the splicing chamber defined by intersecting perpendicular planes extending through the chamber. The movable member is operative for selectively opening the entrance openings of a first and third diagonally opposed quadrants while closing the entrance openings of the second and fourth diagonally opposed quadrants to facilitate splicing of a Z-twisted yarn and, alternatively, for selectively opening the entrance openings of the second and fourth quadrants while closing the entrance openings of the first and third quadrants to facilitate splicing of a S-twisted yarn. Thus, differing air vortices suitable for the differently twisted yarns are generated within the splicing chamber and, advantageously, in order to switch the splicing capability of the splicing head between S-twisted and Z-twisted yarns, the movable member need only be rotated within its recess in the splicing head. In the second-described embodiment, the pair of compressed air entrance openings is formed at diagonally opposed locations on each side of the rotational axis of the movable member whereby, likewise, only rotational adjusting movement of the movable member is necessary to switch between S-twisted and Z-twisted yarns.

Preferably, the splicing chamber of the splicing head is defined to have an essentially circular cross-section to facilitate optimal utilization of the adjusting capabilities of the splicing head, a circular cross-section facilitating the symmetrical formation of compressed air vortices within the chamber which are responsible for performing the yarn splicing operation.

It is also preferred that a cover be provided for movement into and out of covering relation with respect to the insertion slot of the splicing head to provide the further advantage of preventing the yarn ends to be spliced from being blown out the splicing chamber during the splicing process and to prevent the splicing of the yarn ends from being disturbed by undesired air currents.

DESCRIPTION OF THE PREFERRED EMBODIMENT

Figure 1:
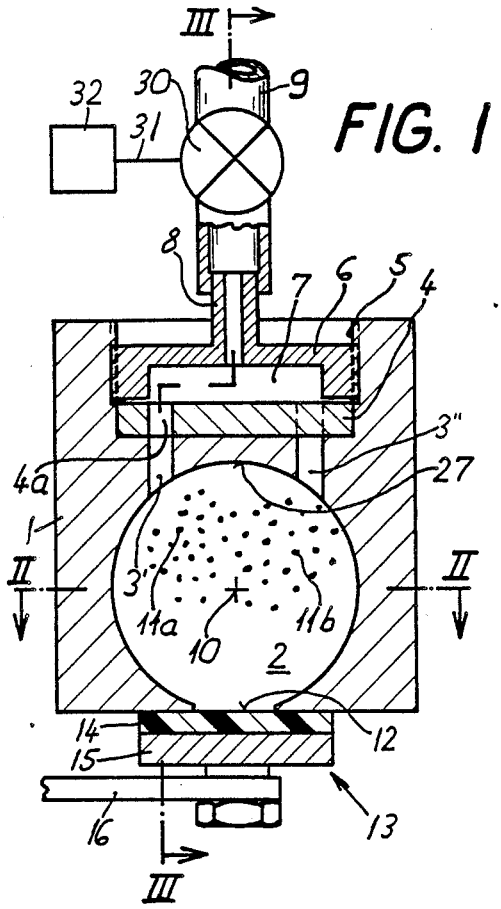
FIG. 1 is a cross-sectional view of a splicing head according to one preferred embodiment of the present invention, taken diametrically through the splicing chamber and through an upper compressed air entrance opening.
Figure 3:
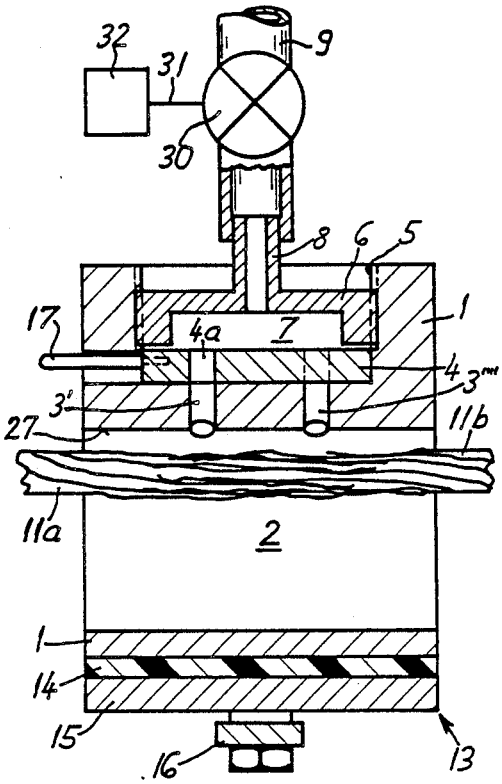
FIG. 3 is another longitudinal cross-sectional view of the splicing head of FIG. 1, taken along line III—III thereof.
Figure 2:
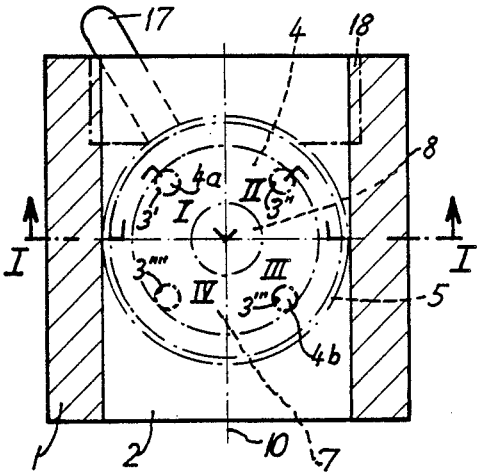
FIG. 2 is another cross-sectional view of the splicing head of FIG. 1, taken longitudinally through the splicing chamber along line II—II of FIG. 1.

Referring now to the accompanying drawings and initially to FIGS. 1–3, one preferred embodiment of a splicing head according to the present invention is indicated generally at 1, the splicing head 1 defining a vertically extending splicing chamber 2 having an essentially circular cross-sectional shape. A longitudinal slot 12 is formed vertically through the forward side of the splicing head 1 essentially parallel with respect to the axis 10 of the splicing chamber 2 to open thereinto for facilitating insertion of yarn ends to be spliced, as represented at 11*a* and 11*b* in FIGS. 1 and 3. A circular recess 5 is formed in the rearward side of the splicing head 1 perpendicularly with respect to the splicing chamber 2 and four compressed air entrance openings 3', 3'', 3''', 3'''' are likewise formed through the splicing head 1 perpendicularly with respect to the splicing chamber 2 to extend in communication between the recess 5 and the chamber 2. A slide plate 4 of a circular shape conforming to the circular configuration of the recess 5 is fitted in the recess 5 for rotational movement therewithin and a cup-shaped closure member 6, likewise of a conforming circular shape, is fitted in the recess 5 to retain the slide plate 4 within the recess 5 while at the same time defining a compressed air chamber 7 between the closure member 6 and the slide plate 4. A central hub portion 8 of the closure member 6 is formed with a central passageway to provide a compressed air supply conduit into the compressed air chamber 7.

A tubular compressed air delivery line 9 is connected to the hub 8 of the closure member 6 for supplying compressed air from a suitable compressed air source (not shown). A regulator valve 30 is provided in the compressed air delivery line 9 and is operatively connected via a control lead 31 to a suitable control device, only representatively shown at 32, which may be of any suitable conventional type. The control device 32 actuates opening and closing movements of the valve 30 for a predetermined time adapted for performing a splicing operation, as more fully explained hereinafter. Alternatively, the control device 32 may be adapted to repetitively open and close the valve 30 in rapid succession in order to deliver compressed air in a pulsating manner into the splicing chamber 7.

The four compressed air entrance openings 3', 3'', 3''', 3'''' open into the splicing chamber 2 in symmetrical relation with respect to a vertical plane extending through the longitudinal center line 10 of the splicing chamber 2. Thus, as best seen in FIG. 2, the compressed air entrance openings 3' and 3'' are formed horizontally adjacent one another in an upper region of the chamber 2 at opposite lateral sides of the center line 10 (see also FIG. 1), while the compressed air entrance openings 3''' and 3'''' are formed horizontally adjacent one another at an axial spacing from the openings 3', 3'' at opposite sides of the center line 10 in a lower region of the splicing chamber 2. The slide plate 4, on the other hand, is formed with only two openings 4*a*, 4*b* formed through the plate 4 at diametrically opposed sides of the central rotational axis of the plate 4. Accordingly, the openings 4*a*, 4*b* in the slide plate 4 enable only two diametrically opposed ones of the four compressed air entrance openings to be opened for communication between the compressed air chamber 7 and the splicing chamber 2 at any time. As will be recognized in FIGS. 1 and 2, the openings 4*a*, 4*b* of the slide plate 4 are aligned with the diagonally opposite compressed air entrance openings 3' and 3''', respectively, while the other compressed entrance openings 3'' and 3'''' are closed by the slide plate 4.

The splicing head 1 is provided with an associated cover, indicated generally at 13 in FIG. 1, which is movable into and out of covering relationship with respect to the yarn insertion slot 12. Thus, when frayed yarn ends prepared for splicing, such as the yarn ends 11*a*, 11*b*, are disposed adjacent one another within the splicing chamber 2 between the laterally adjacent compressed air entrance openings 3' and 3'', 3''' and 3'''', the cover 12 prevents the yarn ends 11*a*, 11*b* from being blown out the splicing chamber 2 when compressed air is admitted into the chamber 2. In addition, the cover 13, by closing the splicing chamber 2 during splicing operations, aids in forming the entering compressed air into vortex air currents as required for optimal splicing of the yarn ends. The cover 13 is preferably formed in two layers of differing materials to facilitate secure closure of the insertion slot 12, basically including a metal backing carrier 15 to which is adhered a layer 14 of an elasticized resilient material, such as a soft plastic or rubber material, adapted to contact the splicing head 1 along opposite sides of the insertion slot 12 when the cover 13 is in its closed position shown in FIGS. 1 and 3. The cover 13 is mounted to a lever 16 connected to a suitable actuator (not shown) for controlling movement of the cover 13 into and out of such slot-closing position.

In FIG. 2, the splicing head 1 is shown in partial section taken along line II—II of FIG. 1 through the longitudinal center line 10 of the splicing chamber 2 so that each of the four compressed air entrance openings 3', 3'', 3''', 3'''' in the splicing head 1 may be seen. The cover 13 and the yarn ends 11*a*, 11*b* are omitted for the sake of clarity. The recess 5 and the slide plate 4 are not visible, but their relative locations and contours are indicated in broken lines. As seen in FIGS. 2 and 3, a handle 17 is affixed to the slide plate 4 and extends outwardly from the splicing head 1 through a guide slot 18 therein to facilitate rotational shifting movement of the slide plate 4 between two operative dispositions determined by abutment of the handle 17 with the respective opposite ends of the slot 18. In a first operative disposition of the slide plate 4, its openings 4*a*, 4*b* are aligned with the compressed air entrance openings 3', 3''' while the body of the slide plate 4 blocks the other entrance openings 3'', 3'''', this disposition of the slide plate 4 being shown in FIGS. 1–3 as aforementioned. In the other operative disposition of the slide plate 4, the openings 4*a*, 4*b* are instead aligned with the compressed air entrance openings 3'', 3'''', while the openings 3', 3''' are blocked.

As may best be understood with reference to FIG. 2, the rearward interior wall surface 27 of the splicing chamber 2 opposite the insertion slot 12 may be considered to be divided into four quadrants defined by a vertical plane through the longitudinal center line 10 of the splicing chamber 2 and a perpendicular horizontal plane through the longitudinal center line of the compressed air entrance hub 8 of the closure member 6. The quadrants are labeled as I, II, III, IV in FIG. 2, with the quadrants I and IV being formed respectively above and below the horizontal plane on the left side of the vertical plane and with the quadrants II and III being formed respectively above and blow the horizontal plane on the right side of the vertical plane. Thus, the compressed air entrance opening 3' is located in quadrant I, the compressed air entrance opening 3'' is located in quadrant II, the compressed air entrance opening 3''' is located in quadrant III, and the compressed air entrance opening 3'''' is located in quadrant IV. Depending upon the disposition of the control handle 17 of the slide plate 4, as above-described, either the diagonally opposed compressed air entrance openings 3' and 3''' in the first and third quadrants (as shown in FIG. 2) or the diagonally opposed compressed air entrance openings 3'' and 3'''' in the second and fourth quadrants are opened by the slide plate 4 for communication between the compressed air chamber 7 and the splicing chamber 2. As will be understood, when the compressed air entrance openings 3' and 3''' are opened, the splicing head is especially suited for splicing yarns having a Z-twist, while the opening of the compressed air entrance openings 3'' and 3'''' renders the splicing head suitable for splicing yarns having a S-twist.

FIG. 3 is a longitudinal section axially through the splicing head 1 along III—III of FIG. 1. As shown, frayed yarn ends 11*a*, 11*b*, which have been prepared for splicing, have been inserted into the splicing chamber 2 and the cover 13 has been moved by its actuating lever 16 into a closed position wherein its resilient material layer 14 snugly contacts the splicing head 1 in covering relation to the insertion slot 12 to close the splicing chamber 2.

The section of FIG. 3 is taken vertically through the compressed air entrance openings 3' and 3'''' in the first and fourth quadrants and, as shown, only the compressed air entrance opening 3' in quadrant I is communicated via the opening 4*a* in the slide member 4 with the compressed air chamber 7 to admit compressed air from the supply conduit 9 into the splicing chamber 2. As above described but not shown in FIG. 3, the compressed air entrance opening 3''' in quadrant III is also communicated with the compressed air chamber 7. The closure member 6 with its tubular hub portion 8 is preferably threadedly engaged into the recess 5 of the splicing head 1, thereby sealably enclosing the recess 5 to form the compressed air chamber 7 and to retain the slide plate 4 within the recess 5, all as above described. As also above described and as shown in FIG. 3, the actuating handle 17 of the slide plate 4 projects outwardly from the splicing head 1 through the slot 18. Thus, the slide plate 4 is positioned within the recess 5 by the closure member 6 for rotationally reciprocal movement actuated by the handle 17 between the two operative dispositions described above as may be desired to thereby activate the compressed air entrance openings 3', 3''' for the splicing of Z-twisted yarns or, alternatively, to activate the compressed air entrance openings 3'', 3'''' for splicing S-twisted yarns.

Figure 5:
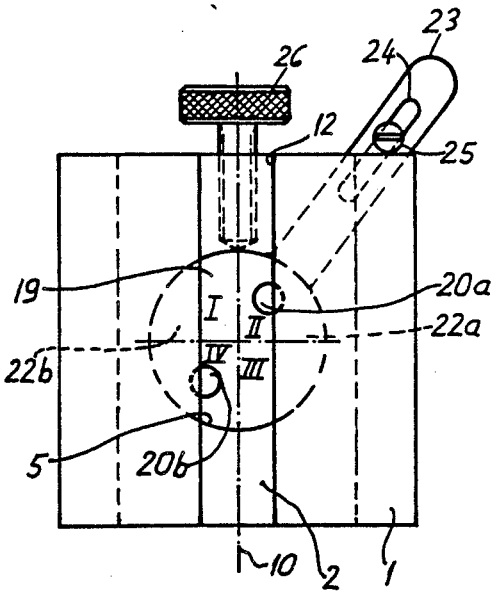
FIG. 5 is a front elevational view of the splicing head of FIG. 4.
Figure 4:
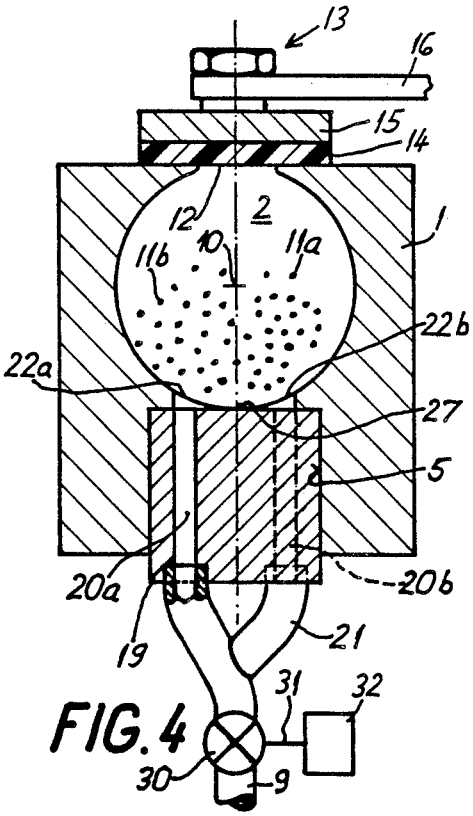
FIG. 4 is a cross-sectional view of another splicing head according to a second preferred embodiment of the present invention, taken diametrically through the splicing chamber and through one air entrance opening thereinto.

Referring now to FIGS. 4 and 5, another embodiment of a splicing head according to the present invention is shown, its components and elements which are comparable to the embodiment of FIGS. 1–3 being designated by the same reference numerals as hereinabove utilized.

In this embodiment, a splicing head 1 is formed with a vertically extending splicing chamber 2 of essentially circular cross-section with a movable cover 13 of substantially the same construction as that of FIGS. 1–3 being movable into and out of covering relation to a yarn insertion slot 12 opening into the chamber 2. A circular recess 5 is also formed in the rearward side of the splicing head 1 but, in contrast to the embodiment of FIGS. 1–3, the recess 5 is formed to a sufficiently greater depth to intersect and open into the splicing chamber 2. An insert member 19 of compatible circular configuration is rotatably fitted in the recess 5 and has a pair of compressed air entrance openings 20*a*, 20*b* formed therethrough at diametrically opposite sides of the central rotational axis of the insert member 19, the section of FIG. 4 being taken through the opening 20*a*. Each of the compressed air entrance openings 20*a*, 20*b* communicates at the rearward outwardly facing side of the insert member 19 with a respective branch of a tubular compressed air supply line 21 into which compressed air is delivered from a suitable source (not shown) through a delivery line 9. A control valve 30 is incorporated into the delivery line 9 and is operated via a control lead 31 by a suitable control device 32, in the same manner as above-described with respect to the embodiment of FIGS. 1–3.

As will be understood, since the recess 5 and the insert member 19 have compatible circular cross-sectional shapes, the insert member 19 is adapted to be rotationally positioned in any desired disposition relative to the splicing head 1 and, likewise, the insert member 19 may be axially, i.e. longitudinally, shifted toward and away from the splicing chamber 2 as desired. The interior walls of the splicing head 1 defining the splicing chamber 2 form shoulders 22*a*, 22*b* at opposite lateral sides of the recess 5 at its juncture with the splicing chamber 2 to act as stops to limit the shifting movement of the insert member 19 toward the splicing chamber 2. Thus, the configuration of the recess 5 and the insert member 19 permit the compressed air entrance openings 20*a*, 20*b* to be positioned in substantially any desired relationship with respect to yarn ends 11*a*, 11*b*, which have already been frayed and inserted into the splicing chamber 2 in preparation for splicing.

FIG. 5 is a front elevational view of the splicing head shown in FIG. 4, the cover 13 and the yarn ends 11*a*, 11*b* having been omitted for the sake of clarity. The boundaries of the recess 5 as it opens into the splicing chamber 2 can be clearly seen. The stop shoulders 22*a*, 22*b* formed at the right and left hand junctures of the splicing chamber 2 with the recess 5 are symmetrical with respect to the longitudinal center line 10 of the splicing chamber 2, each of the shoulders 22*a*, 22*b* limiting the forward positioning of the insert member 19 toward the splicing chamber 2. As shown in FIG. 5, the compressed air entrance openings 20*a*, 20*b* of the insert member 19 are disposed by way of example in quadrants II and IV as defined in the same manner as described in the embodiment of FIGS. 1–3 by a vertical plane through the longitudinal center line 10 of the splicing chamber 2 and a perpendicularly intersecting horizontal plane diametrically through the splicing chamber 2 and through the central axis of the insert member 19. Thus, the compressed air entrance openings 20*a*, 20*b* are located so that the splicing head 1 is suited for splicing yarns having an S-twist.

As in the embodiment of FIGS. 1–3, the insert member 19 is provided with a handle 23 extending outwardly from the splicing head 1 for convenient shifting operation of the insert member 19. Preferably, the handle 23 is in the form of a lever arm fixed to the insert member 19. Thus, the insert member 19 can be rotationally shifted into any desired position by means of the handle 23 so that, for example, the compressed air entrance openings 20*a*, 20*b* alternatively can be properly located for splicing either S-twisted or Z-twisted yarns. Specifically, since the compressed air entrance openings 20*a*, 20*b* are formed at diametrically opposite sides of the rotational axis of the insert member 19, the openings may be disposed either in the first and third quadrants I and III or in the second and fourth quadrants II and IV.

The handle 23 includes a lengthwise slot 24 at the outer end of the lever arm in which a locking screw 25 is shiftably disposed. The locking screw 25 projects from the handle 23 to abut the body of the splicing head 1 to act as a stop for the adjusting movement of the handle 23 and, in turn, of the insert member 19. Thus, by adjustably positioning the lock screw 25 within the handle slot 24, the handle 23 can be controlled to shift the compressed air entrance openings 20*a*, 20*b* within the four quadrants at any selected relative disposition longitudinally and laterally with respect to the center line 10 of the splicing chamber 2 within the rotational arc of movement of the openings 20*a*, 20*b*. The insert member 19 can be secured against any unintentional shifting movement by provision of a clamping screw 26 threadedly supported in the splicing head 1 for movement into and out of peripheral clamping engagement with the insert member 19 to prevent undesired rotational and longitudinal shifting thereof.

As those persons of skill in the art will recognize, the described embodiment of FIGS. 4 and 5 may be modified in various ways without departing from the substance and scope of the present invention. For example, the insert member 19 may be provided with more than two compressed air entrance openings. Likewise, the handle may be fabricated in another shape so as to function both as a shift lock and an integrated clamping means, e.g., by provision of the handle assembly with a leaf spring adapted to engage into positioning recesses in the splicing head.

Figure 6:
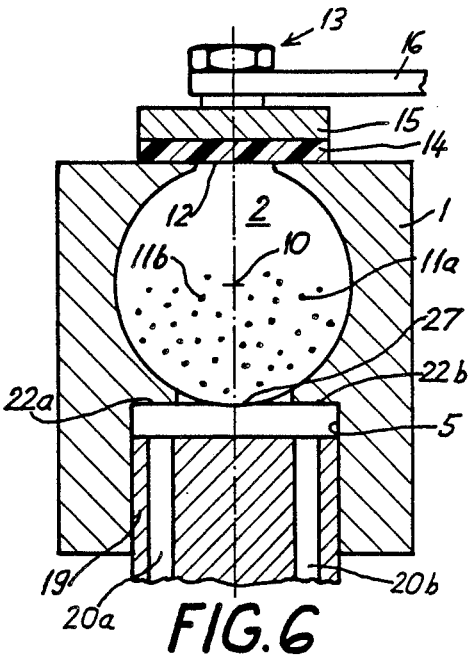
FIG. 6 is another diametrical cross-sectional view of the splicing head of FIG. 4, showing its movable member adjustably moved into another operative disposition.

FIG. 6 depicts the splicing head 1 of FIGS. 4 and 5 with its insert member 19 adjustably shifted into an alternative operating disposition. Specifically, the insert member 19 is rotatably disposed in FIG. 6 with the two compressed air entrance openings 20*a*, 20*b* located symmetrically in a common horizontal plane perpendicular to the longitudinal center line 10 of the splicing chamber 2. As will be recognized, in such disposition the compressed air entrance openings 20*a*, 20*b* would be covered by the stop shoulders 22*a*, 22*b* and, accordingly, the insert member 19 is also slightly retracted within the recess 5 away from the stop shoulders 22*a*, 22*b*. In this disposition of the insert member 19, specialized air vortexing conditions may be created within the splicing chamber 2 to act on the yarn ends 11*a*, 11*b* which have been prepared for splicing.

Figure 7:
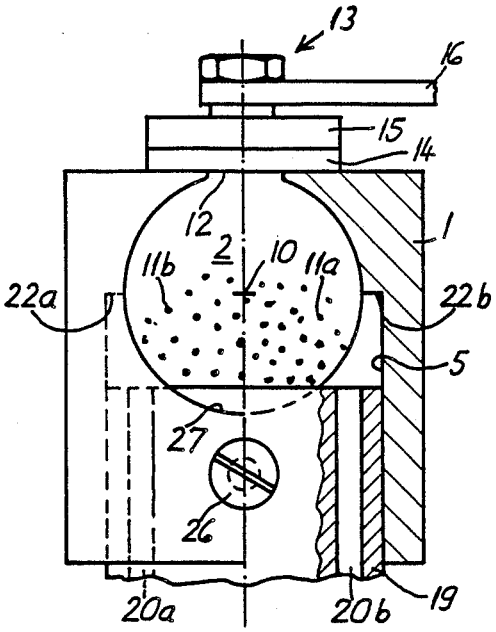
FIG. 7 is a view of a splicing head according to another embodiment of the present invention generally similar to the embodiment of FIG. 4, shown partly in end elevation and partly in cross-section diametrically through the splicing chamber.

FIG. 7 illustrates another embodiment of a splicing head 1 similar in construction to the splicing head 1 of FIGS. 4–6, but having a rearward recess 5 which is both of an enlarged diameter and also extends horizontally to a terminal end defined by stop shoulders 22*a*, 22*b* coinciding with the longitudinal center line 10 of the splicing chamber 2. As illustrated, the insert member 19 is not extended fully into the recess 5 into abutment with the stop shoulders 22*a*, 22*b*, but nevertheless is extended beyond the rearwardmost interior wall surface 27 of the splicing chamber 2 diametrically opposite the insertion slot 12. As in the embodiment of FIGS. 4–6, two compressed air entrance openings 20*a*, 20*b* are formed through the insert member 19 at diametrically opposite sides of its central rotational axis, the insert member 19 being shown in FIG. 7 as shifted into a disposition wherein the openings 20*a*, 20*b* are located symmetrically in a common horizontal plane perpendicular with respect to the longitudinal center line 10 of the splicing chamber 2, similar to the disposition of the insert member 19 in FIG. 6. Thus, as in the embodiment of FIGS. 4–6, the insert member 19 of FIG. 7 can be selectively positioned within its recess 5 in the splicing head 1 to dispose its compressed air entrance openings 20*a*, 20*b* at differing positions on both sides of a plane of symmetry through the center of the splicing chamber 2 intersecting its longitudinal center line 10. Moreover, the insert member 19 and its compressed air entrance openings 20*a*, 20*b* can be adjustably positioned and fixed within the recess 5 toward and away from the splicing chamber 2 to project into the splicing chamber 2 to differing degrees relative to the wall surface 27. The insert member 19 may be fixed with respect to the splicing head 1 in any particular disposition by means of a clamping screw 26. The maximum degree to which the insert member 19 can be advanced within the recess 5 into the splicing chamber 2 is defined by the depth of the recess 5 itself, terminating in stop shoulders 22*a*, 22*b*. As desired, additional stops can also be provided within the recess 5 to thusly limit the axial and rotational shifting of an insert member 19 in a recess 5 of any other shape.

The depth of the recess 5 as defined by the stop shoulders 22*a*, 22*b* can be selected so that the stop shoulders 22*a*, 22*b* partially cover the cross-sectional area of the compressed air entrance openings 20*a*, 20*b* when positioned as shown in FIG. 7 in a common plane perpendicular to the longitudinal center line of the splicing chamber 2. In this manner, the cross-sectional areas of the compressed air entrance openings 20*a*, 20*b* can also be effectively varied by shifting movement of the insert member 19 with respect to the shoulders 22*a*, 22*b*.

A similar variation of the cross-sectional areas of the compressed air entrance openings is also possible in the embodiment of FIGS. 1–3 by enlarging or reducing the compressed air entrance openings 3′, 3″, 3‴, 3⁗ or by staggering the openings 4*a*, 4*b* in the slide plate 4 relative to the compressed air entrance openings 3′, 3″, 3‴, 3⁗.

Thus, the splicing head of the present invention substantially avoids the disadvantages of the prior art. As will be recognized, the adjustability of the splicing head of the present invention enables a single splicing head to readily be adjusted to perform the splicing functions of a number of different prior art splicing heads, whereby the need to maintain an inventory of a plurality of interchangeable splicing heads to satisfy differing splicing operations with differing yarn characteristics can be substantially eliminated. Additionally, the splicing head of the present invention avoids the disadvantages of splicing heads wherein a plurality of compressed air entrance openings are each provided with an individual compressed air supply line operated by an individual respective control valve. Such splicing heads not only involve an increased design expense but also require a more complicated control technology since the time periods for opening and closing the plural individual valves must be precisely coordinated with respect to one another. Additionally, such splicing devices are subject to an increased susceptibility to failure and the space required to accommodate such a splicing device would preclude the use of such a device at each individual spinning or winding position of a multi-position spinning or winding machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a yarn splicing device of the type adapted for splicing a pair of staple fiber yarn ends by compressed air, a stationarily disposed splicing head comprising means defining a splicing chamber for receiving the yarn ends, means defining a slot opening into said splicing chamber for insertion of the yarn ends thereinto, means for selectively defining a pair of compressed air entrance openings for delivering compressed splicing air into said splicing chamber at differing locations therein for selectively generating differing splicing air vortices within said splicing chamber in relation to characteristics of the yarn ends, said means for defining said compressed air entrance openings comprising means defining a plurality of said entrance openings and means movable between differing operative dispositions for selectively opening and closing said entrance openings in predetermined pairs, and means defining a common conduit from a common source of compressed air to each of said compressed air entrance openings for supplying compressed air to said entrance openings, said supplying means including a controllable valve in said common conduit, said movable means comprising a slide member disposed between said supplying means and said splicing chamber.

2. A splicing head in a splicing device according to claim 1 and characterized further in that said means for defining said compressed air entrance openings comprises a member having a pair of air entrance openings formed therein and movably mounted to said chamber defining means for selectively varying the disposition of said air entrance openings relative to said splicing chamber for selective communication between said supplying means and said splicing chamber.

3. A splicing head in a splicing device according to claim 2 and characterized further in that said chamber defining means defines a recess opening into said splicing chamber and receiving and conforming to said movable member.

4. A splicing head in a splicing device according to claim 3 and characterized further in that said movable member is selectively positionable in said recess toward and away from said splicing chamber.

5. A splicing head in a splicing device according to claim 3 and characterized further in that said movable member and said recess are of compatible circular configurations permitting selective rotational positioning movement of said movable member relative to said splicing chamber.

6. A splicing head in a splicing device according to claim 2 and characterized further by stop means for limiting positioning movement of said movable member.

7. A splicing head in a splicing device according to claim 2 and characterized further in that said movable member includes a handle accessible from the exterior of said splicing head for actuating positioning movement of said movable member.

8. A splicing head in a splicing device according to claim 1 and characterized further by stop means for limiting positioning movement of said movable member.

9. A splicing head in a splicing device according to claim 1 and characterized further in that said movable member includes a handle accessible from the exterior of said splicing head for actuating positioning movement of said movable member.

10. A splicing head in a splicing device according to claim 1 and characterized further in that said means defining a plurality of said entrance openings defines four said compressed air entrance openings each opening into a respective one of four quadrants of said splicing chamber defined by intersecting perpendicular planes extending through said chamber, said movable means being operative for selectively opening the entrance openings of a first and third diagonally opposed quadrants while closing the entrance openings of a second and fourth diagonally opposed quadrants and for selectively opening the entrance openings of the second and fourth quadrants while closing the entrance openings of the first and third quadrants.

11. A splicing head in a splicing device according to claim 1 and characterized further in that said splicing chamber is of an essentially circular cross-section.

12. A splicing head in a splicing device according to claim 1 and characterized further by a cover movable into and out of covering relation to said insertion slot.

13. A splicing head in a splicing device according to claim 1 and characterized further in that said means for defining said compressed air entrance openings includes means for varying the effective cross-sectional areas of said entrance openings.

14. In a yarn splicing device of the type adapted for splicing a pair of staple fiber yarn ends by compressed air, a stationarily disposed splicing head comprising means defining a splicing chamber for receiving the yarn ends, means defining a slot opening into said splicing chamber for insertion of the yarn ends thereinto, means for selectively defining a pair of compressed air entrance openings for delivering compressed splicing air into said splicing chamber at differing locations therein for selectively generating differing splicing air vortices within said splicing chamber in relation to characteristics of the yarn ends, said means for defining said compressed air entrance openings comprising means defining four said compressed air entrance openings each opening into a respective one of four quadrants of said splicing chamber defined by intersecting perpendicular planes extending through said chamber, means movable between differing operative dispositions for selectively opening the entrance openings of a first and third diagonally opposed quadrants while closing the entrance openings of a second and fourth diagonally opposed quadrants and for selectively opening the entrance openings of the second and fourth quadrants while closing the entrance openings of the first and third quadrants, and means defining a common conduit from a common source of compressed air to each of said compressed air entrance openings for supplying compressed air to said entrance openings, said supplying means including a controllable valve in said common conduit.

* * * * *